US005959602A

United States Patent [19]

Welzen

[11] Patent Number: 5,959,602

[45] Date of Patent: Sep. 28, 1999

[54] LIQUID-CRYSTAL DISPLAY WITH ADDRESSING SCHEME TO ACHIEVE HIGH CONTRAST AND HIGH BRIGHTNESS VALUES WHILE MAINTAINING FAST SWITCHING

[75] Inventor: Theo L. Welzen, Maastricht, Netherlands

[73] Assignee: Citizen Watch Co., Ltd., Tokyo, Japan

[21] Appl. No.: 08/598,070

[22] Filed: Feb. 7, 1996

Related U.S. Application Data

[62] Continuation of application No. 08/441,007, May 15, 1995, which is a continuation of application No. 08/142,428, filed as application No. PCT/JP94/00421, Apr. 1, 1993, abandoned.

[30] Foreign Application Priority Data

Apr. 1, 1992 [NL] Netherlands ..... 9200606

[51] Int. Cl.[6] ..... G09G 3/36

[52] U.S. Cl. ..... 345/99; 345/94; 345/100

[58] Field of Search ..... 345/93, 94, 100, 345/210, 95, 99

[56] References Cited

U.S. PATENT DOCUMENTS 5,262,881 11/1993 Kuwata et al. ..... 345/93
5,546,102 8/1996 Schetter ..... 345/100

FOREIGN PATENT DOCUMENTS 27 52 602 5/1979 Germany .
645473 9/1984 Switzerland .

OTHER PUBLICATIONS

"A Generalized Addressing Technique For RMS Responding Matrix LCDS", T. N. Ruckmongathan, IEEE, pp. 80–85, (1988).

*Primary Examiner*—Richard A. Hjerpe
*Assistant Examiner*—Kent Chang
*Attorney, Agent, or Firm*—Finnegan, Henderson, Farabow, Garrett & Dunner, L.L.P.

[57] ABSTRACT

In a liquid-crystal display device having a matrix structure, a plurality of lines is selected simultaneously during periodic scanning of the line electrodes, and the total selection time is split into a number of time intervals which occur distributed over the frame time. The select voltages required can be chosen to be considerably smaller than the voltages according to the standard Alt & Pleshko multiplex addressing scheme, which results in considerably lower voltages over the display elements during selection. These lower voltages, combined with the splitting of the total selection period per frame time into a number of time intervals distributed over the frame time lead to a reduction of the so-called "FRAME RESPONSE" behavior and therefore result in improved contrast and brightness of rapidly switching liquid-crystal effects compared to the Alt & Pleshko addressing.

11 Claims, 10 Drawing Sheets

$t_a$
$\frac{1}{2}t_a$
$\frac{1}{2}t_a$
A
0
-A
$V_S$
0
FRAME TIME
FRAME TIME
FRAME TIME

LIQUID-CRYSTAL DISPLAY WITH ADDRESSING SCHEME TO ACHIEVE HIGH CONTRAST AND HIGH BRIGHTNESS VALUES WHILE MAINTAINING FAST SWITCHING

This application is a continuation of application Ser. No. 08/441,007, filed May 15, 1995, which is a continuation of application Ser. No. 08/142,428, filed Nov. 30, 1993, now abandoned, which is a 371 of PCT application No.: PCT/JP93/00421, filed Apr. 1, 1993.

TECHNICAL FIELD

The invention relates to a display device comprising a liquid-crystal material between two supporting plates kept at a defined spacing whose surfaces face each other, a pattern of N line electrodes being arranged on the one surface, and a pattern of column electrodes being arranged on the other surface, which line electrodes cross the column electrodes and the crossing points thus form a matrix of display elements. The device comprises a control circuit for supplying data signals to the column electrodes and furthermore comprises a line-scanning circuit for periodic scanning of the line electrodes and supplying suitable line-select voltage signals.

BACKGROUND OF ART

Such display devices are known and are usually operated by way of multiplex-addressing according to the so-called RMS mode.

The method of addressing (based on the so-called RMS behaviour of the liquid-crystal material) has been described, inter alia, by Alt and Pleshko in I.E.E.E. Trans. El. Dev. DE 21, 1974, pp. 146–155, by Nehring and Kmetz in I.E.E.E. Trans. El. Dev. ED 26, 1979, pp. 795–802, and by Kawakami et al. in SID-IEEE Record of Biennial Display Conference, 1976, pp. 50–52. This method of addressing is considered to be the most common for addressing liquid-crystal display devices which are constructed as a matrix of pixels as described above, in which use is not made of one active electronic switch (such as, for example, a thin-film transistor) per pixel.

Using this method of addressing, the pixels are switched, from a first state to an optically different second state with the aid of the line-scanning circuit which periodically scans the line electrodes using a line-select pulse of magnitude $V_s$ and with the aid of the control circuit for supplying data signals to the column electrodes, which control circuit applies data voltages of magnitude $\pm V_d$ to the column electrodes over the time during which a line electrode is being scanned, in such a way that the optical state which is effected in a display element is determined by the so-called Root Mean Square (RMS) voltage value over the element in question.

The RMS voltage value $V_2$ for the display elements not selected, i.e. the display elements in the ON state, is given by:

$$V_2^2=(V_s+V_d)^2/N+(N-1)*V_d^2/N \quad (1)$$

The RMS voltage value $V_1$ for the display elements not selected, i.e. the display elements in the OFF state, is given by:

$$V_1^2=(V_s-V_d)^2/N+(N-1)*V_d^2/N \quad (2)$$

FIG. 2 shows, in diagrammatic form, a transmission voltage characteristic of a picture cell belonging to that display device.

Alt & Pleshko have derived relationships which, for a given value of the ratio $S=V_2/V_1$ (sometimes called threshold slope in the transmission voltage characteristic curve) indicate the maximum number of lines $N_{max}$ which can be addressed by this method while maintaining a predefined contrast value and in what manner the voltage $V_s$ of the line-select pulse and the data voltages $\pm V_d$ must be chosen to achieve this. These relationships are as follows:

$$N_{max}=\{(S^2+1)/(S^2-1)\} \quad (3)$$

$$(V_s/V_d)^2=N_{max} \quad (4)$$

$$V_d^2=V_1^{2*}\{0.5/(1-Q)\} \quad (5)$$

where: $Q^2=N_{max}$

In the line-select voltage $V_s$ and the data voltage $V_d$ are then chosen in accordance with the expressions (2) and (3), the resulting RMS voltage, when using $N_{max}$ lines, over a selected pixel will be equal to $V_2$, and the resulting RMS voltage over a non-selected pixel will be equal to $V_1$.

A greater multiplexing rate, in other words a higher value for $N_{max}$, requires a steeper slope of the transmission voltage characteristic curve, i.e. a value for the quantity $S=V_2/V_1$ closer to 1.0.

By means of the currently known (and already used) so-called "SUPER-TWISTED" liquid-crystal effects it is possible to achieve very high values for $N_{max}$, because the threshold slope S of the transmission voltage characteristic curve of these effects has a value which is very close to the limit value 1.0. FIG. 1, in diagrammatic form, shows part of a matrix-oriented display device 1 having $N_{max}$ selection lines (line electrodes) 2, and describes in principle the functioning of the RMS multiplex-addressing method mentioned earlier.

The information to be displayed is supplied to the data lines (column electrodes) 3. At the location of the crossing points of the selection lines 2 and the data lines 3 there are the display elements 4. Depending on the information supplied on the data lines 3, the display elements 4 are in an ON state or OFF state.

Synchronously with the selection of the lines or row electrodes with the aid of the line-select voltage $V_s$ (which has been selected in accordance with the expressions (4) and (5)), the image information (data voltage $\pm V_d$) is applied via the column electrodes. Thus, from the time $t_1$ and over a period $t_1$ (sometimes called line time), line $\mathbf{2}^a$ is selected which, together with the information then present on the data lines $\mathbf{3}^a$, $\mathbf{3}^b$, $\mathbf{3}^c$ (i.e. $\pm V_d$) determines the optical state of the pixels $\mathbf{4}^{aa}$, $\mathbf{4}^{bb}$, $\mathbf{4}^{cc}$.

During this period $t_1$ when line $\mathbf{2}^a$ is selected, all the other pixels corresponding to the line electrodes $\mathbf{2}^b$, $\mathbf{2}^c$ etc. are at a voltage $\pm V_d$.

From time $t_2$ (where: $t_2-t_1=t_1$) line $\mathbf{2}^b$ is selected over period $t_1$. The information then present on the data lines 3 (i.e. $\pm V_d$) determines the state of the pixels $\mathbf{4}^{ba}$, $\mathbf{4}^{bb}$, $\mathbf{4}^{bc}$.

After said line time $t_1$, the next line is then selected. Thus the whole picture is written line-by-line. After the last line of the matrix has been selected, the whole cycle is repeated (so-called "repeated scan procedure"). The duration of a single write cycle is called the frame time $t_f$: $t_f=N * t_1$, N representing the number of lines which are thus scanned successively.

An important point with this RMS addressing method is that both the rise time and the fall time (in other words, the switching time for the transition to the 'ON' or 'OFF' state, respectively) of the optical effect are much greater than the frame time.

Under these circumstances, the display element reacts to the cumulative effect of a number of addressing pulses (or select pulses). Under these conditions, a liquid-crystal display element in particular reacts in the same way as if it had been addressed by a sinusoidal-wave signal or a stepped-wave signal or the like, having the same RMS voltage value as that of the 'ON' and 'OFF' voltages $V_2$ and $V_1$ given by the expressions (1) and (2).

As already discussed, the maximum number of selection lines $N_{max}$ is related to the value of the ratio $V_2/V_1$ (threshold slope).

As the multiplexing rate increases, increasingly higher voltages are necessary when using the RMS multiplex-addressing method described above.

The line-select voltage $V_s$ in particular will become high (the data or column voltage $V_d$ in this addressing scheme should always be chosen to be lower than the threshold voltage of the optical effect).

The high select voltages result in the liquid-crystal effect no longer reacting to the RMS voltage value (RMS voltage mean over a frame time), but in the pixel showing an optical response which is determined by the 'instantaneous' voltage value sensed by the element in question during the line-selection time. FIG. 3, in diagrammatic form, shows the transmission behaviour over one frame time of such a display element in the 'ON' state.

The 'ON' state is already reached during the line time $t_1$ during which the element in question senses a voltage of magnitude $V_s+V_d$, because the 'ON' switching time at sufficiently high voltages will become smaller than or equal to said line time. After selection, that is after the line time $t_1$, the pixel in question only senses a voltage $\pm V_d$ which is smaller than the threshold voltage. This means that the pixel in question, during the remaining frame time, will return to its 'OFF' state. In FIG. 3 it is assumed, for the sake of simplicity, that said fall time (in other words, 'OFF' switching time) is of the same magnitude as the frame time.

This characteristic so-called "non-RMS" transmission behaviour has been observed, inter alia, with liquid-crystal display devices having super-twisted liquid-crystal configurations, and particularly in the case of display devices having very thin liquid-crystal layer thicknesses. It is known that the switching times of a liquid-crystal effect depend strongly on said layer thickness. As the layer thickness becomes smaller, the switching time will decrease. See, inter alia, Okada et al. in SID Digest of Technical Papers XXII, 1991, pp. 430–433.

The outlined transmission behaviour (often referred to as "FRAME RESPONSE") in FIG. 3 leads to loss of brightness and contrast compared to a liquid-crystal effect reacting in a true RMS manner.

DISCLOSURE OF THE INVENTION

The object of the invention is to provide a display device in which, with a given high multiplexing rate and a given thin liquid-crystal layer thicknesses (which are important to effect fast switching), the "FRAME RESPONSE" behaviour described is reduced or eliminated, so that, while maintaining fast switching, contrast and brightness are improved, specifically in such a way that those contrast values and brightness values are achieved or approximated which arise if the optical effect shows true RMS behaviour. To this end, said display device according to the invention is characterised in that an addressing scheme is used in which the single, large select pulse for every line per frame time has been replaced by a plurality of smaller pulses which are distributed over the frame time in a regular manner.

The invention is based on the insight that using a plurality of smaller pulses during the frame time, instead of the single large select pulse per line, is possible if a plurality of lines are selected simultaneously during the frame time.

Simultaneous selection of a plurality of lines during scanning of the matrix (multiplexing) does not, if the voltage waveform of the select voltage and of the data wave signals are chosen in a suitable manner, lead to a reduction of the maximum number of lines which can be addressed. For a given transmission voltage characteristic curve having a slope $V_2/V_1$, $N_{max}$ is again determined in accordance with expression (3) which has been derived for the case of RMS behaviour.

Simultaneous selection of a plurality of lines during the frame time leads not only to a select signal having a smaller amplitude compared to standard RMS addressing, but at the same time provides the possibility of splitting the select signal with its associated selection period into a plurality of separate select pulses having a corresponding shortened pulse duration.

BEST MODE FOR CARRYING OUT THE INVENTION

The invention will now be explained in more detail with reference to a number of illustrative embodiments.

In the first illustrative embodiment (FIG. 4*a* and 4*b*), it is assumed that during the frame scan, simultaneous selection of two lines takes place.

For the sake of simplicity it is assumed that the number of lines N of the matrix is a multiple of 'two'.

Figure 1:
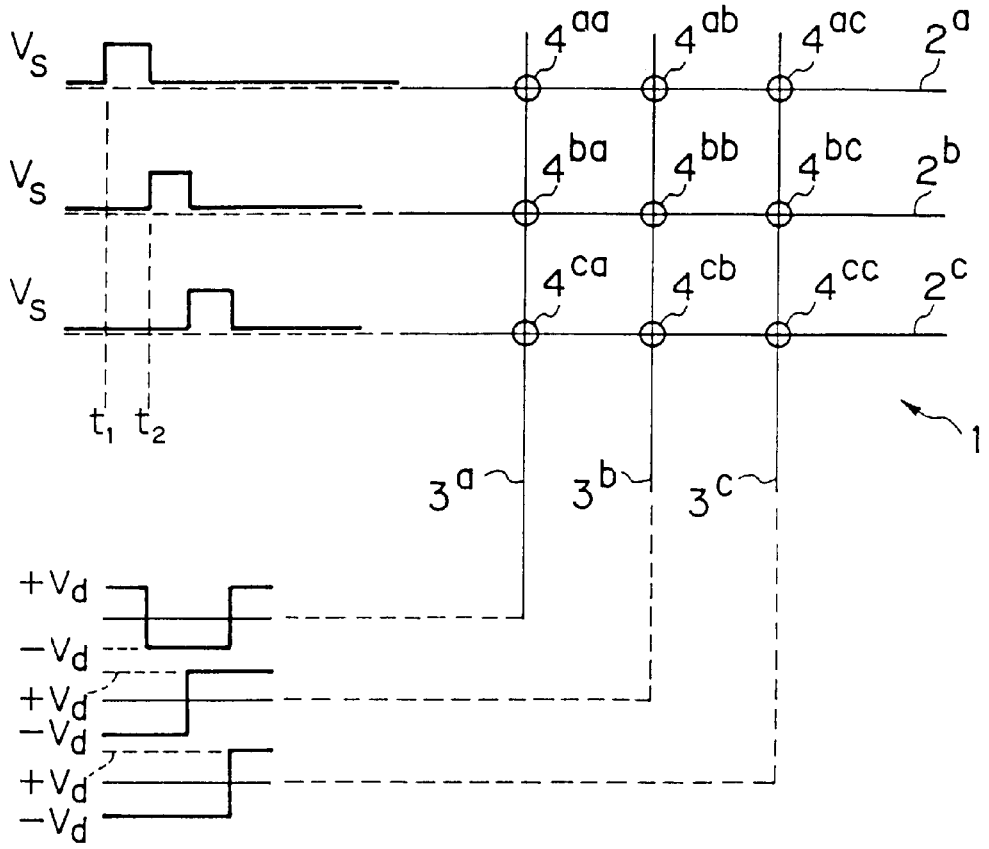
FIG. 1 shows a diagram indicating a part of matrix-oriented display device.
Figure 2:
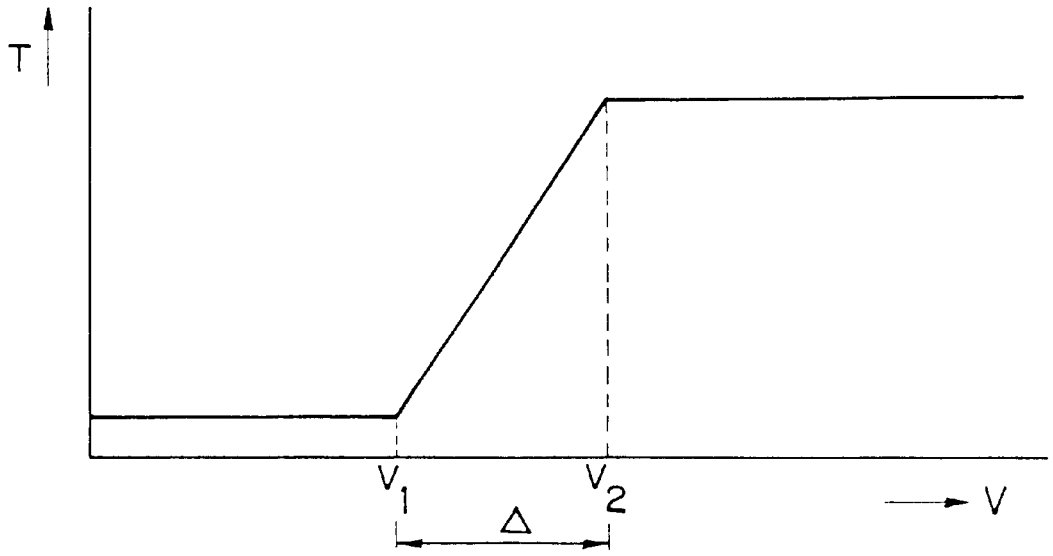
FIG. 2 shows a transmission voltage characteristic of a picture cell of the display device.
Figure 3:
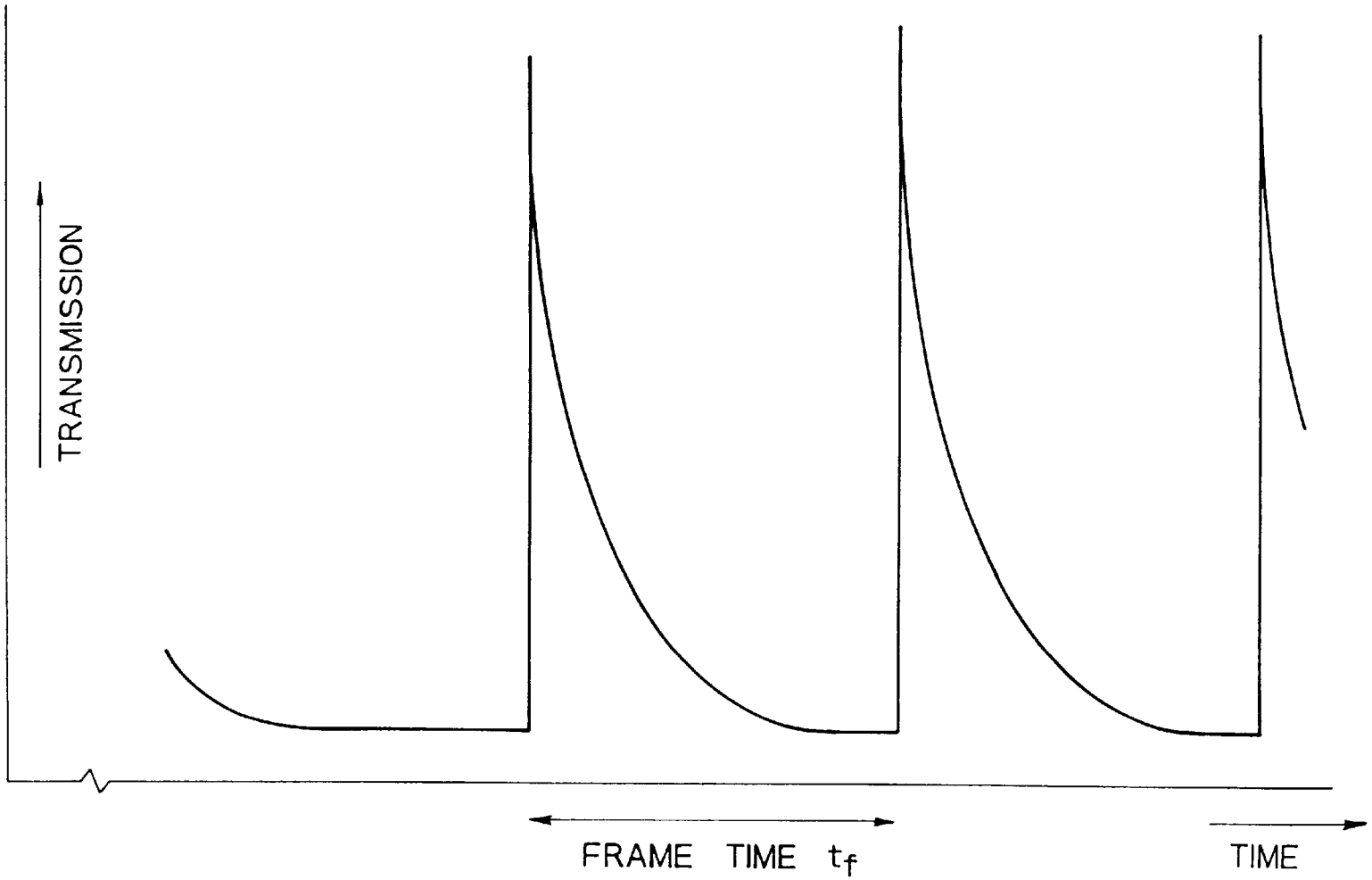
FIG. 3 shows a transmission behavior of the display device over one frame time.
Figure 4A:
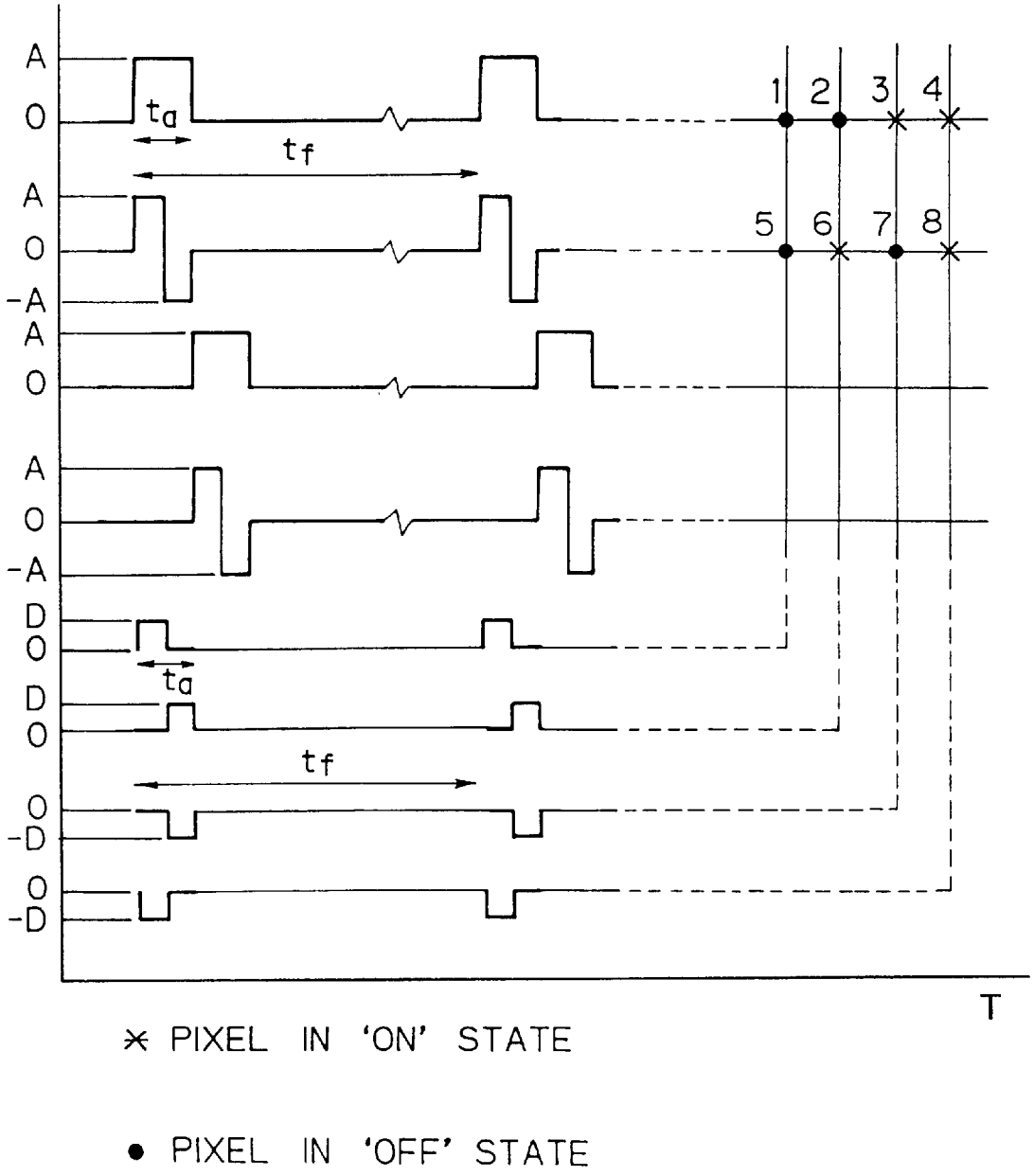
FIG. 4*a* and 4*b* show one embodiment of the present invention.

The select time is then defined as the addressing time $t_a$. FIG. 4*a* shows voltage waveforms for the line signals and the data signals which can be used to write the information as represented in this figure by means of he designations 'ON' and 'OFF'.

After the addressing time $t_a$, as illustrated in FIG. 4*a*, the next two lines are selected, and with the aid of a column control circuit, the appropriate data voltages are applied to the columns in accordance with the information then to be written. The frame time tf in this example is given by: $t_f=(N/2) * t_a$.

The line-select voltage signals of the two lines selected simultaneously are mutually orthogonal.

In FIG. 4*a* it is assumed, for the sake of simplicity, that two adjacent lines are selected. This is not necessary, however, since any two lines of the N-line matrix can be selected simultaneously using this addressing method. Obviously, each line will always be selected only during an addressing time $t_a$ for each frame time.

Just as with standard multiplex addressing, as described hereinbefore, "repeated scanning" takes place here.

The amplitude of the line-select voltage signals for the two lines to be selected simultaneously is equal to ±A.

Instead of the voltage waveforms illustrated for the two lines to be selected simultaneously, it is also possible to choose voltage waveforms having a higher frequency. In that case the data voltage signals will have to be adapted and they will be different from those illustrated in FIG. 4*a*.

The amplitude of the data voltages in FIG. 4*a* which are supplied to the columns during the addressing time $t_a$ to write the desired information, during one half of the addressing time is equal to ±D and during the other half of the addressing time is equal to 0. The actual shape of a data voltage signal is determined by information to be displayed (i.e. the pixels 'ON' or 'OFF').

FIG. 4*a* gives the four data voltage signals by which the possible information contents of the pixels in question which occur on the selected lines can be effected using the line-select voltage waveforms illustrated: i.e. the combination 'OFF'/'OFF' (column 1), 'OFF'/'ON' (column 2), 'ON'/'OFF' (column 3), 'ON'/'ON' (column 4).

The pixels 1, 2, 5, 7 of the matrix illustrated in FIG. 4*a* are assumed to be in the 'OFF' state; the pixels 3, 4, 6, 8 are in the 'ON' state.

In order to prevent D.C. components, it is possible, for example, to change the polarity of the line-select voltages and the data voltages after each frame time (in analogy to standard Alt & Pleshko multiplex addressing).

For the sake of simplicity, no such polarity change is drawn in FIG. 4*a*.

Figure 4B:
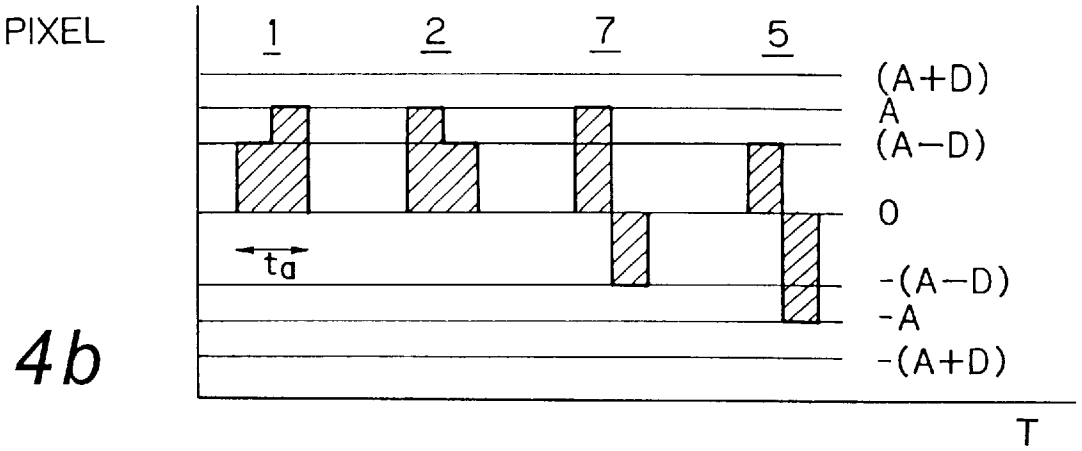
Figure 4C:
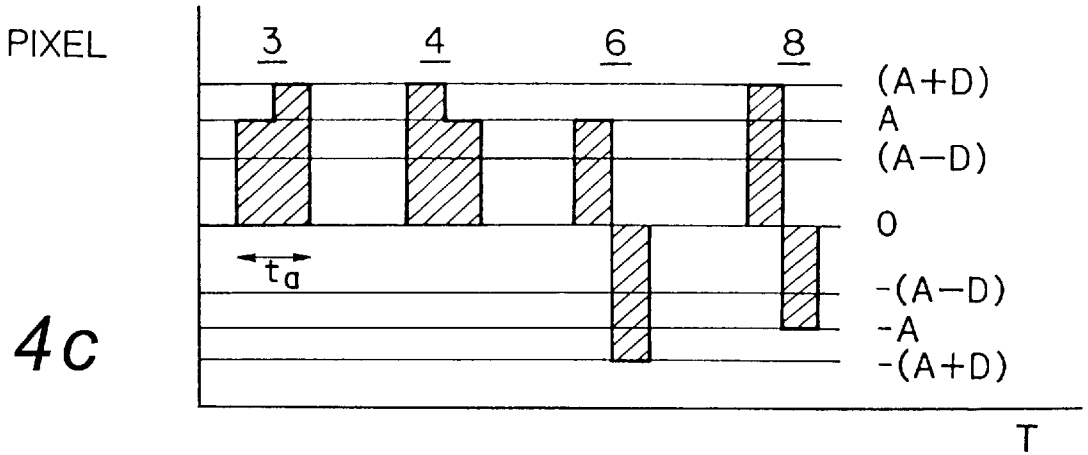

FIG. 4*b* shows the resulting voltages over the pixels 1 to 8 inclusive of FIG. 4*a* over the addressing time $t_a$. The resulting voltage has been derived as the difference voltage $V_{line}-V_{column}$.

FIG. 4*b* shows that the RMS voltage values during the addressing time $t_a$ of the pixels 1, 2, 5, 7 which are in the 'OFF' state, are equal to one another.

Similarly, the RMS voltage values of the 'ON' elements are equal to one another during $t_a$.

It is possible to verify, with the aid of FIG. 4*a*, that any 'ON' element and 'OFF' element in the matrix has the same RMS voltage value during the rest of the frame time (that is, during $t_f-t_a$).

The following expression can be derived for the RMS voltage value $V_{on}$:

$$V_{on}^2=\{t_a*(A^2/2+(A+D)^2/2)+t_a*(N/2-1)*D^2/2\}/\{t_a*N/2\} \quad (6)$$

The RMS voltage value $V_{off}$ of an 'OFF' element is given by the following expression:

$$V_{off}^2=\{t_a*(A^2/2+(A-D)^2/2)+t_a*(N/2-1)*D^2/2\}/\{t_a*N/2\} \quad (7)$$

With the aid of the "Lagrange Multiplier" technique, it is possible to determine the maximum of $V_{on}$ as a function of the voltages A and D on condition that $V_{off}$ is equal to the threshold voltage $V_1$.

The following expressions are then found:

$$(A/D)^2=N/4 \quad (8)$$

$$D^2=V_1^2*2*\{0.5/(1-Q)\} \quad (9)$$

where: $Q^2=N^{-1}$

If equations (8) and (9) are substituted into the expressions (6) and (7), the following is found for the ratio $V_{on}/V_{off}$:

$$(V_{on}/V_{off})^2=\{Q^{-1}+1\}/\{Q^{-1}-1\} \quad (10)$$

With $V_{off}=V_1$ and the definition for the slope $S=V_2/V_1$, it follows that expression (10) is in fact identical with expression (3) which shows the relationship between the number of lines to be multiplexed (in this illustrative embodiment: N) and the slope of the transmission voltage characteristic curve.

If expressions (8) and (9) are compared with the expressions (4) and (5), it follows that the amplitude D of the data signals in the case of simultaneous selection of two lines is greater by a factor of $2^{1/2}$ than the data voltage $V_d$ required according to standard Alt & Pleshko RMS multiplex addressing (for identical number of lines N of the matrix).

The amplitude A of the line-select voltages for simultaneous selection of two lines is smaller by a factor of $2^{1/2}$ than the select voltage $V_s$ required according to standard Alt & Pleshko RMS multiplex addressing (for identical number of lines N of the matrix). All this means that the maximum voltage amplitude (A+D) of an 'ON' element in the case of the addressing scheme described above with simultaneous selection of two lines is significantly smaller than the maximum voltage amplitude ($V_s+V_d$) for the same element in the case of addressing according to the standard Alt & Pleshko principle.

Consider once more the voltage waveforms of the line-select signals and the data signals of FIG. 4*a*.

The complete addressing time ta is in fact composed of two equal timespans $t_a/2$ with associated characteristic voltage values for the line-select signals and the data signals.

In order to effect the desired RMS voltage values for $V_{on}$ and $V_{off}$ (according to expressions (8) and (9)) it is not necessary for the selection timespans $t_a/2$ with the associated voltages to occur directly after one another as has been assumed in the voltage waveforms in FIG. 4*a*.

Figures 5A, 5B, 5C:
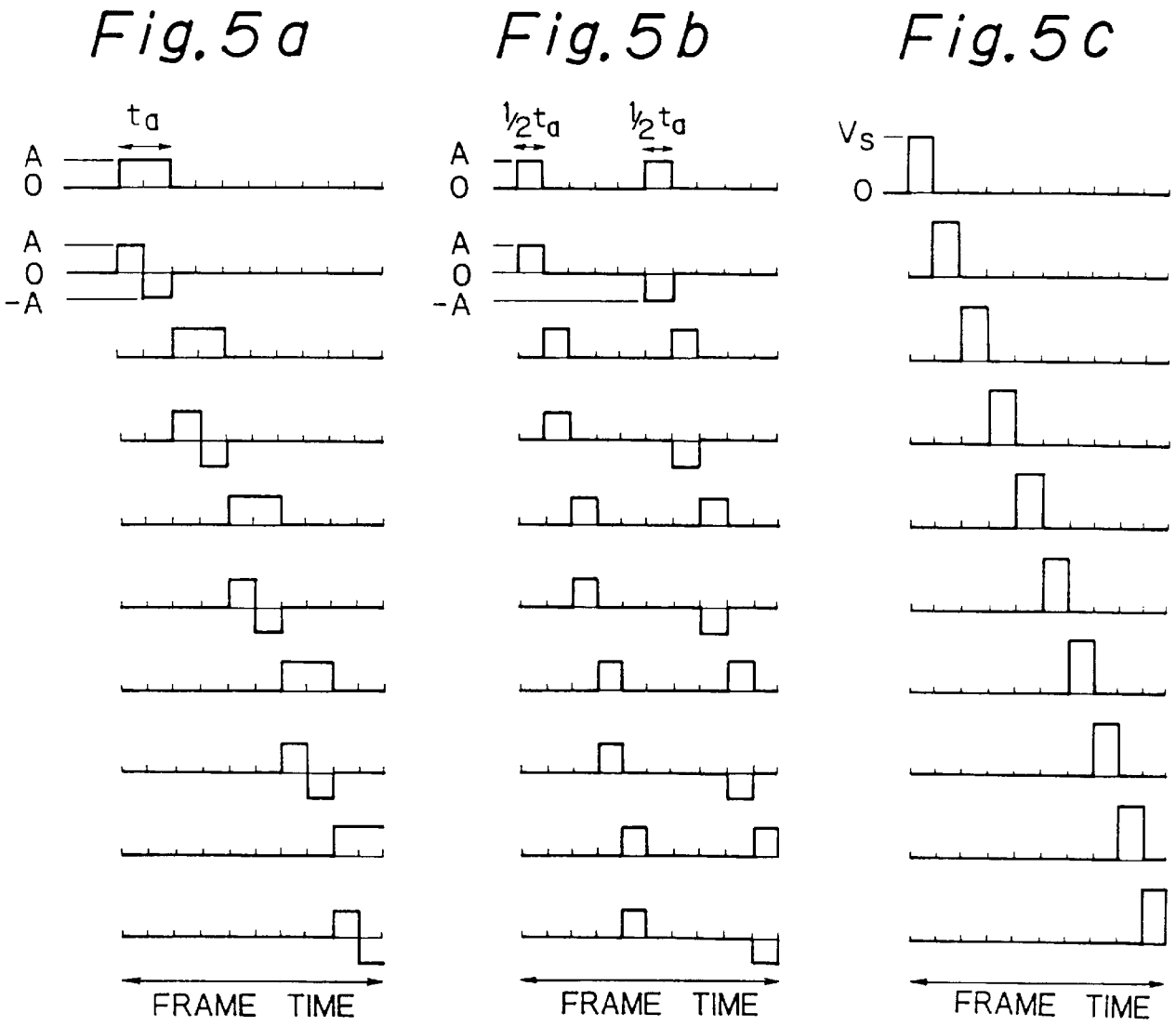
FIG. 5*a* to 5*c* show diagrams indicating wave forms for the second selection timespan ta/2 chosen from a point in time following after half the frame time.

The second selection timespan $t_a/2$ may, for example, be chosen from a point in time following after half the frame time. This is illustrated in FIG. 5 with the aid of a matrix of 10 lines. For the sake of simplicity, only the line-select voltage signals of the 10 lines during the scanning of the matrix over one frame time are shown. The situation illustrated is that in which two adjacent lines are selected. As has already been indicated earlier, this is not necessary. FIG. 5*a* shows the scanning cycle in which the addressing time $t_a$ has not been split. In FIG. 5*b*, the line selection period ta has been split into two timespans $t_a/2$, the second half of the total addressing time $t_a$ taking place from a point in time which is situated halfway along the frame time. FIG. 5*c*, for comparison, shows the addressing scheme according to the standard RMS multiplex method with the selection of a single line.

It will be clear that it will be necessary, for the scanning scheme as drawn in FIG. 5*b*, to adapt the control circuit for the data signals so as to apply the appropriate data voltages to the columns.

The principle of the scanning scheme according to FIG. 5*b* is obviously applicable not only to the 10-line matrix shown but to each matrix having any number of lines N. In the case that N is not a multiple of 2, matrix-addressing according to this principle can take place by introducing a so-called 'dummy' or virtual line.

The addressing scheme described in FIG. 5*b* results in an addressing method in which the single select pulse of standard Alt & Pleshko multiplex addressing has been replaced by two separate select pulses having smaller amplitudes and preferably occurring at points in time which are uniformly distributed over the frame time. As already discussed, the maximum amplitude of the voltage over a pixel (during selection) for this addressing method is smaller than in the case of standard Alt & Pleshko addressing.

Both the occurrence of a plurality of select pulses having a lower amplitude than the single select pulse in Alt & Pleshko addressing, and the fact that the maximum voltage over a pixel during selection is smaller than the corresponding voltage in the Alt & Pleshko addressing scheme have a positive effect on reducing or eliminating "FRAME RESPONSE".

In the case that the addressing scheme described above comprising simultaneous selection of two lines and splitting of the total addressing time $t_a$ into two separate selection timespans $t_a/2$ as outlined in FIG. 5*b*, are not sufficient to reduce or eliminate "FRAME RESPONSE", an addressing scheme can be chosen in which more than two lines are selected simultaneously, for example 4, or 6, or 8 etc.

It is not necessary, however, for an even number of lines to be selected simultaneously.

In the following illustrative embodiment of the invention (FIG. 6*a* and 6*b*), it is described how addressing of an N-line matrix can take place if 4 lines are selected simultaneously during the frame scan.

For the sake of simplicity, it is assumed that the number of lines N of the matrix is a multiple of 'four'. This is, however, not necessary (in analogy with addressing in which two lines are selected simultaneously, as discussed earlier).

Figure 6A:
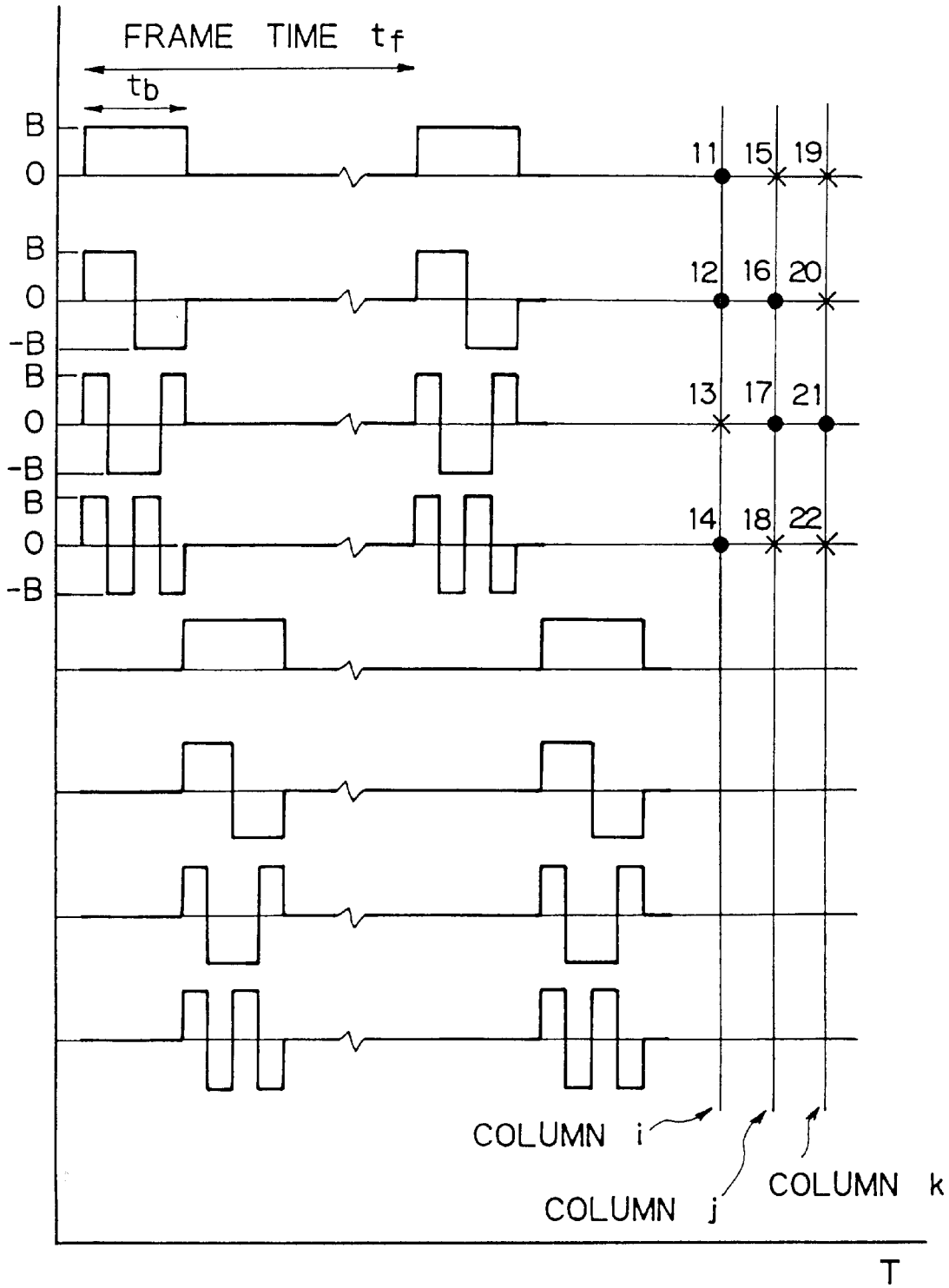
FIGS. 6*a* and 6*b* show another embodiment of the present invention.

The selection time is now defined as the addressing time $t_b$. FIG. 6*a* shows voltage waveforms for the line signals which can be used to write the information as illustrated in this Figure. For the sake of simplicity, FIG. 6*a* shows only three columns i, j, k, with the associated information contents of the pixels 11 to 22 inclusive which correspond to the crossing points of the columns i, j, k and the illustrated first group of four lines to be selected simultaneously. To illustrate the data signals required, the pixels 11, 12, 13, 14 belonging with column i are assumed to be 'OFF', 'OFF', 'ON' and 'OFF', respectively. The elements 15, 16, 17, 18 belonging to column j are 'ON', 'OFF', 'OFF' and 'ON', respectively. The pixels 19, 20, 21, 22 belonging to column k are 'ON', 'ON', 'OFF' and 'ON', respectively.

After the addressing time $t_b$, the next 4 lines are selected. The frame time $t_f$ in this example is given by:

$$t_f=(N/4)*t_b.$$

The line-select voltage signals of the four simultaneously selected lines are mutually orthogonal, in such a way that the select signal of one of the four lines to be selected simultaneously has a half-period which corresponds to the addressing time $t_b$. In FIG. 6*a*, this is the first (uppermost) line of the group of lines to be selected simultaneously. It is not necessary, however, for this particular line to have this line-select voltage wave form.

In FIG. 6*a* it is assumed, for the sake of simplicity, that selection of four adjacent lines takes place. This is not necessary, however, as any set of four lines of the N-line matrix can be selected simultaneously using this addressing method. Obviously, each line will always be selected only during an addressing time tb for each frame time. "Repeated scanning" takes place.

The amplitude of the line-select voltage signals for the four lines to be selected simultaneously is equal to ±B. In order to prevent D.C. voltage components, it is possible, for example, to change the sign of the polarity of both the line-select voltages and the data signals, after each frame time. For the sake of simplicity, this polarity change is not illustrated in FIG. 6*a*.

Instead of the voltage waveforms illustrated for the four lines to be selected simultaneously, voltage waveforms having a higher frequency can be chosen alternatively. In that case, the data wave signals will have to be adjusted. and they will be different from those drawn in FIG. 6*b*.

Figure 6B:
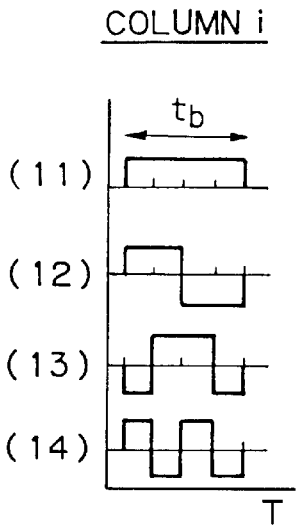
Figure 6C:
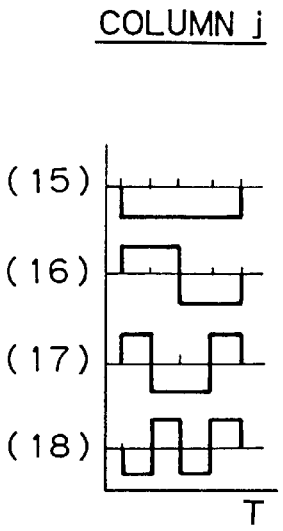
Figure 6D:
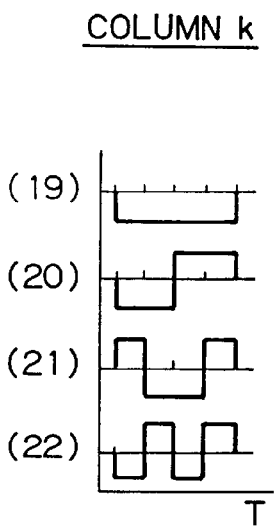
Figure 6E:
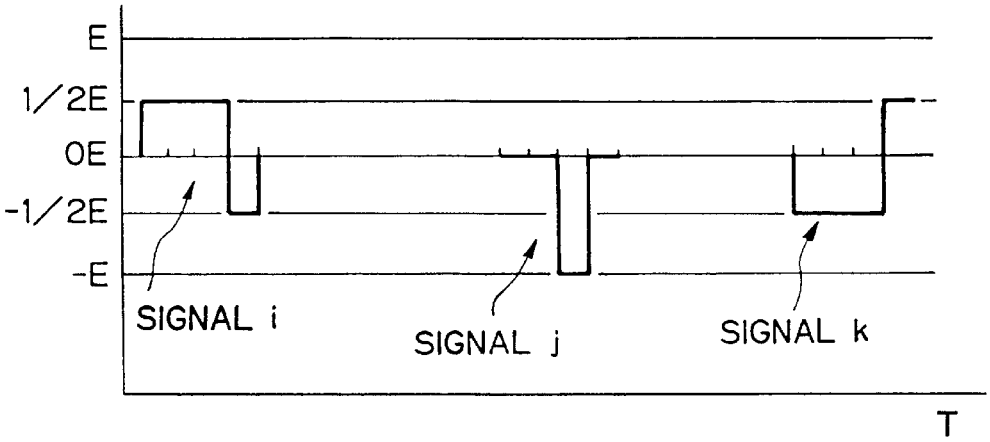

FIG. 6*b* illustrates in which manner the data signals can be determined in order to write the information as depicted in FIG. 6*a*.

First consider, in this context, the pixels 11, 12, 13, 14 belonging to column i. Pixel 11 should be in the 'OFF' state. In order to effect this, the data signal applied to pixel 11 during selection should be a data voltage signal which is in phase with the line-select signal of the corresponding selected line. This signal is drawn in FIG. 6*b* in the column whose heading reads COLUMN i. The amplitude X of this signal (and the amplitude of the line-select signals) are determined by the requirement that the RMS voltage value of the 'OFF' elements must have a determined value while the RMS voltage value of the 'ON' elements should be as large as possible. Pixel 12 should be in the 'OFF' state, and in analogy with the situation described above, the data voltage signal to be applied to pixel 12 during selection should be in phase with the line-select signal of the corresponding line. This signal is drawn in FIG. 6*b* in the column having the heading COLUMN i. The amplitude of this signal is equal to the amplitude of the above data signal for pixel 11.

Pixel 13 should be 'ON'. Therefore, a data signal should be applied to pixel 13 during selection, which is in antiphase with the line-select signal of the corresponding line. This data signal for pixel 13 again has the same amplitude as the two data signals mentioned earlier of pixels 11 and 12 and is shown in the column whose heading is COLUMN i. The data signal for pixel 14 during selection follows on the basis of reasoning analogous to that given for the other pixels in the column i in question. When summed, said four data signals produce the data signal as drawn in FIG. 6*b* in the column whose heading is COLUMN i. During selection of the four lines to which the elements 11, 12, 13, 14 belong, this signal is applied to column i. In a completely analogous manner, the data signal can be determined which has to be applied to column j in order to produce the required information contents of pixels 15, 16, 17, 18. FIG. 6*b* illustrates all these aspects by means of the voltage waveforms during selection for the elements in question and the total voltage (signal j) which, during selection, is applied to column j (see column with heading COLUMN j). the column with heading COLUMN k, for illustrative purposes, shows the data voltage signals and the total voltage of signal k for the column k in question (see signals drawn in the column with heading COLUMN k).

If four lines are selected simultaneously, data signals should be applied in which 5 levels can be distinguished, namely ±E/2, 0. The combination of these levels in a data signal applied to a column 1 during selection is determined by the image contents of the elements in the column 1 in question.

Figure 7A:
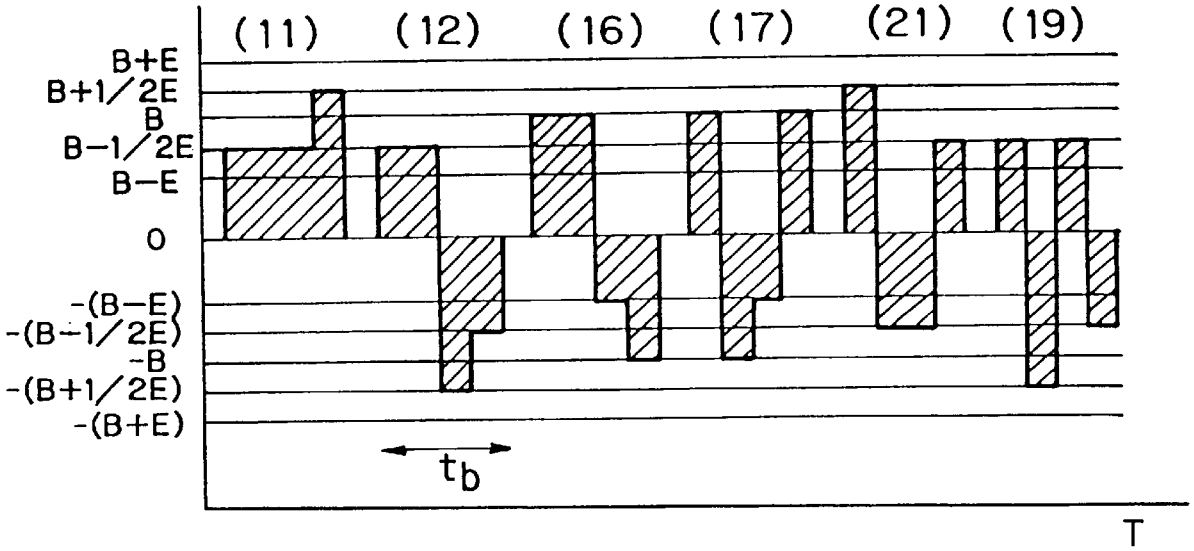
FIG. 7 shows the resulting voltages of the line-select signals and the data signals for elements 11 to 22 as shown in FIGS. 6*a* and 6*b* during the selection time tb.
Figure 7B:
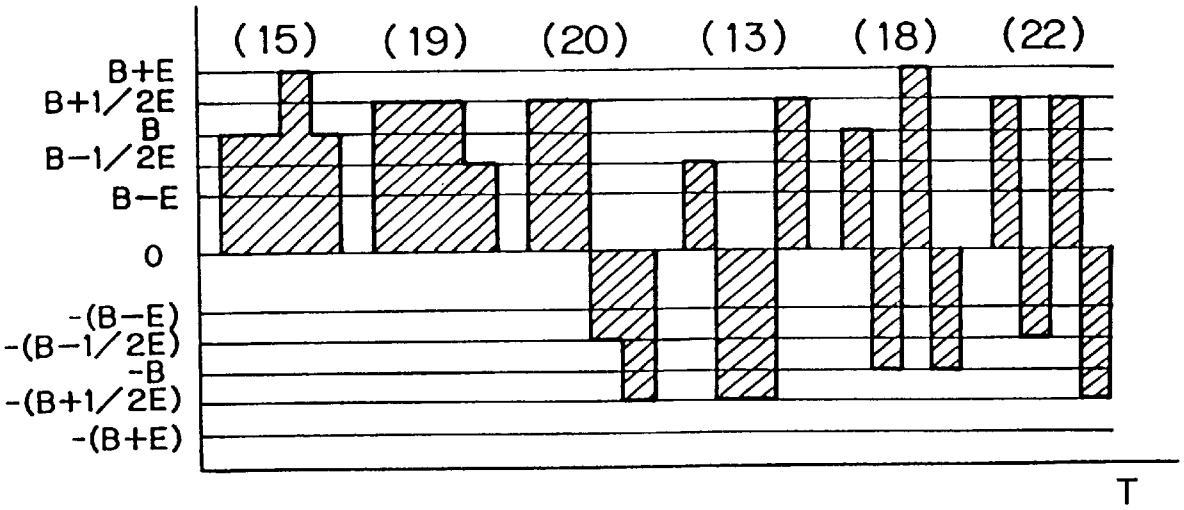

FIG. 7 shows the resulting voltages (defined as $V_{line}-V_{column}$) for elements 11 to 22 inclusive of FIG. 6*a* during the selection time $t_b$ utilising the line-select signals drawn in FIG. 6*a* and the data signals (signal i, signal j, signal k) drawn in FIG. 6*b*. The RMS voltage values during the selection time $t_b$ of the 'OFF' elements 11, 12, 16, 17, 21, 14 are equal to one another. The RMS voltage values during the selection time $t_b$ of the 'ON' elements 15, 19, 20, 13, 18, 22 are equal to one another. After selection and during the remainder of the frame time $t_f$, i.e. over a period $t_f-t_b$, the RMS voltage value of any 'OFF' element is equal to the RMS voltage value of any 'ON' element.

The following expression can be derived for the RMS voltage value $V_{on}$ of an 'ON' element:

$$V_{on}^2=\{t_b*(B^2+B*E/2+E^2/4)+(N/4-1)*t_b*E^2/4\}/(N*t_b/4) \quad (11)$$

The RMS voltage value Voff of an 'OFF' element is given by the following expression:

$$V_{off}^2=\{t_b*(B^2-B*E/2+E^2/4)+(N/4-1)*t_b*E^2/4\}/(N*t_b/4) \quad (12)$$

On condition that $V_{off}=V_1$, $V_{on}$ can be maximised for a given N as a function of B and E.

The maximum is found as:

$$(B/E)^2=N/16 \quad (13)$$

$$E^2=4*V_1^{2*}\{0.5/(1-Q)\} \quad (14)$$

where $Q^2=N^{-1}$

The following is then found for the ratio $V_{on}/V_{off}$:

$$(V_{on}/V_{off})^2=\{Q^{-1}+1\}/Q^{-1}-1\} \quad (15)$$

With $V_{off}=V_1$ and the definition for the slope $S=V_2/V_1$ it follows that expression (15) is in fact identical with expression (3) which shows the relationship between the number of lines to be multiplexed (in this illustrative embodiment: N) and the slope of the transmission voltage characteristic curve.

If expressions (13) and (14) are compared with the expressions (4) and (5), it follows that the amplitude E in the case of simultaneous selection of four lines is greater by a factor of 2 than the data voltage $V_d$ required according to standard Alt & Pleshko multiplex addressing (for identical number of lines N of the matrix). The amplitude B of the line-select voltages for simultaneous selection of four lines is smaller by a factor of 2 than the select voltage $V_s$ required according to standard Alt & Pleshko RMS multiplex addressing (for identical number of lines N of the matrix).

Consider once more the voltage waveforms of the line-select signals of FIG. 6*a* and the voltage waveforms of the data signals of FIG. 6*b*.

The complete addressing time $t_b$ is composed of four equal timespans $t_b/4$ with associated characteristic voltage values for the line-select signals and the data signals. In order to produce the desired RMS voltage values for $V_{on}$ and $V_{off}$ (according to expressions (11) to (14) inclusive), it is not necessary for the selection timespans $t_b/4$ with the associated voltages to occur in direct succession as has been assumed in the voltage waveforms in FIG. 6*a* and FIG. 6*b*. The selection timespans $t_b/4$ and associated voltages can be distributed over the frame time.

Figure 8A:
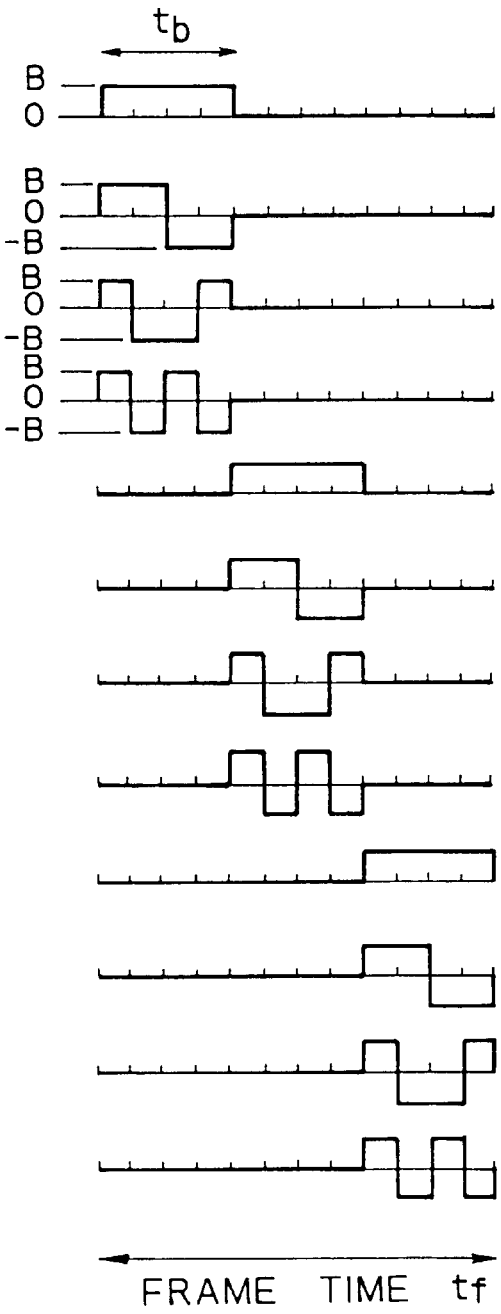
FIGS. 8*a* and 8*b* show the relationship between the selection timespan tb/4 and associated voltage over the frame time.
Figure 8B:
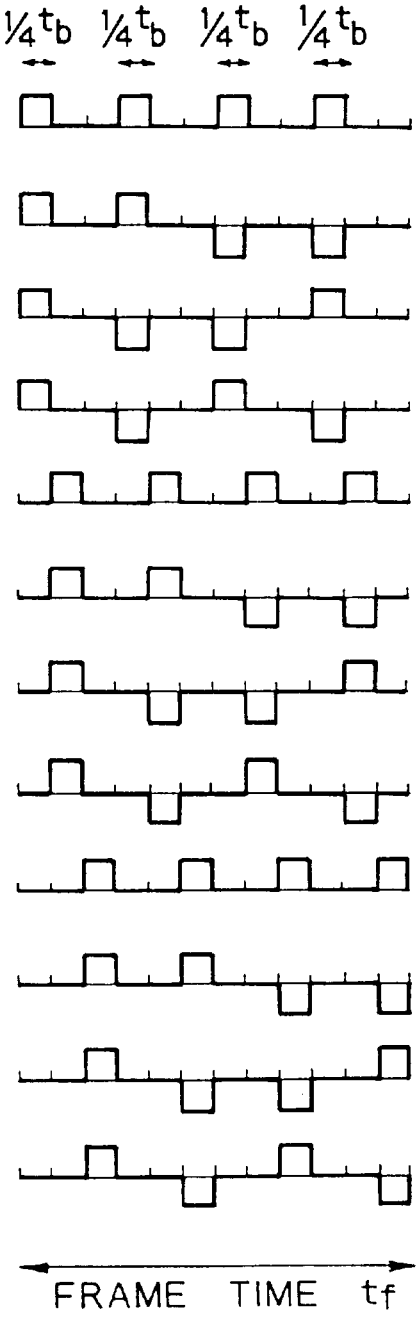

This is illustrated in FIG. 8 with the aid of a matrix of 12 lines. For the sake of simplicity, only the line-select voltage signals of the 12 lines during the scanning of the matrix over a frame time are shown. The situation illustrated is that in which four adjacent lines are selected simultaneously. As has already been indicated earlier, this is not necessary. FIG. 8*a* shows the scanning cycle in which the line selection period $t_b$ has not been split. In FIG. 8*b*, the line selection span $t_b$ has been split into four timespans $t_b/4$, which are uniformly distributed over the frame time. Other distributions are obviously also possible, for example a uniform distribution over the frame time of two selection timespans which are each equal to $t_b/2$.

It will be necessary, for the scanning scheme as drawn in FIG. 8*b* (but also for other distributions of the total line-selection period $t_b$ over the frame time as indicated hereinbefore) to adapt the control circuit for the data signals so as to apply the appropriate data voltages to the columns. The principle of the scanning scheme according to FIG. 8*b*, in the case of simultaneous selection of four lines and distribution of the total selection period into smaller selection timespans (with associated voltages) which are distributed over the frame time, is obviously applicable not only to the 12-line matrix shown but to each matrix having any number of lines N. In the case that N is not a multiple of 4, matrix-addressing with simultaneous selection of four lines can take place by introducing so-called 'dummy' or virtual lines. The addressing scheme illustrated in FIG. 8*b* results in an addressing method in which the single select pulse of standard Alt & Pleshko multiplex addressing has been replaced by four separate select pulses having smaller amplitudes and preferably occurring at points in time which are uniformly distributed over the frame time. The maximum amplitude of the voltage over the frame time. The maximum amplitude of the voltage over a pixel (during selection) for this addressing method is smaller than in the case of standard Alt & Pleshko addressing. In the case of simultaneous addressing of four lines it is also possible, as already discussed, to make use of, for example, two separate selection time-spans having an equal duration $t_b/2$ which may or may not be uniformly distributed over the frame time.

In case the addressing scheme described above comprising simultaneous selection of four lines and splitting of the total selection period $t_b$ into four separate, equal selection period spans as outlined in FIG. 8*b*, are not sufficient to reduce or eliminate "FRAME RESPONSE", an addressing scheme can be chosen in which more than four lines are selected and the total selection period is again split into a number of selection timespans which may or may not be equal and which are or are not uniformly distributed over the frame time, in analogy to the manner as illustrated with the aid of the addressing schemes in which two or four lines are selected simultaneously. On the basis of the descriptions and explanations provided of the procedure to be followed for establishing the correct addressing scheme in the case of simultaneous selection of four and two lines, anybody who is reasonably skilled in the art is able to derive the line-select signals and the data signals which can be used for simultaneous addressing of other numbers of lines (other than two and four).

Figure 9:
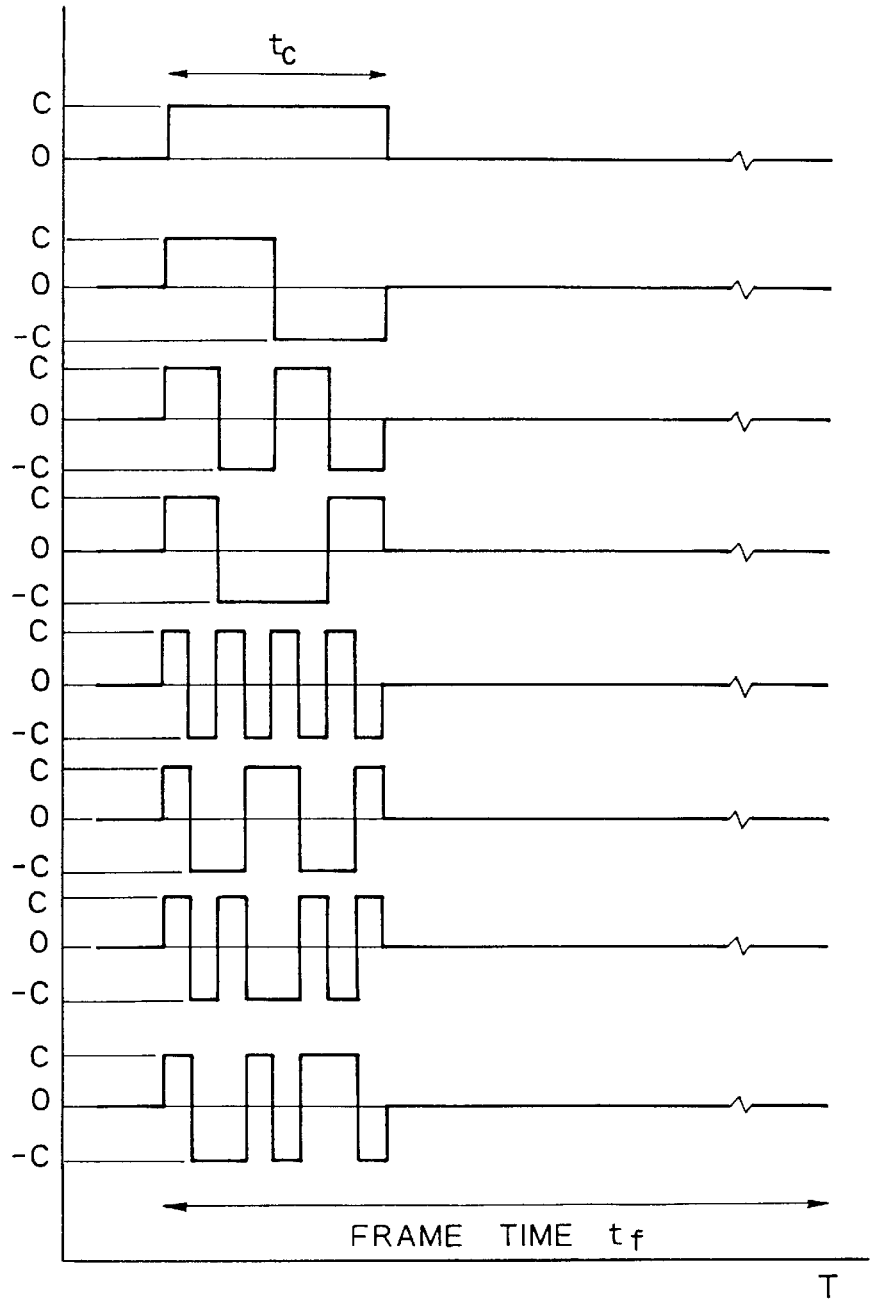
FIG. 9 shows the line-select signals used to define smaller selection periods than the total selection period tc.

Though not really necessary, in the illustrative embodiment of the invention to be described now, line-select voltage signals which can be used in the case of simultaneous selection of eight lines are given in FIG. 9. The select signals in FIG. 9 are again orthogonal, and one of the voltage signals used has a half-period which corresponds to the addressing time (selection time). The data signals which are used in combination with said line-select signals can be determined according to the principle described for the case of addressing a matrix with simultaneous selection of four lines (see, inter alia, FIG. 6*b* and relevant text).

The line-select signals of FIG. 9 can again be used to define smaller selection periods than the total selection period $t_c$ shown in this figure, for example eight selection timespans of magnitude $t_c/8$. Said eight selection periods may, for example, be uniformly distributed over the frame time, in analogy to the descriptions of the distributions in FIG. 8*b* and FIG. 5*b*.

Obviously, the amplitudes of the line-select voltages and the maximum amplitudes of the data signals will have to be chosen in such a way that the ratio of the resulting RMS voltage values of an 'ON' element and an 'OFF' element: $V_{on}/V_{off}$ is at a maximum when $V_{off}=V_1$.

When n lines are selected simultaneously, the amplitude $Y_n$ of the line-select signals and the maximum amplitude $X_n$ of the data signals will have to be chosen according to:

$$Y_n=N^{1/2}*X_n/n \tag{16}$$

$$Y_n=n^{1/2}*V_1*\{0.5/(1-Q)\}^{1/2} \tag{17}$$

where: $Q^2=N^{-1}$

The table below illustrates for a number of values of n, how many and which voltage levels may occur in the data signals which, in combination with line-select signals whose waveform is indicated in the illustrative embodiments given earlier, will lead to a desired image content.

n=2: $\pm X_2$, 0 n=3: $\pm X_3$, $\pm X_3/3$ n=4: $\pm X_4$, $\pm X_4/2$, 0 n=5: $\pm X_5$, $\pm 3*X_5/5$, $\pm X_5/5$ n=6: $\pm X_6$, $\pm 4*X_6/6$, $\pm 2*X_6/6$, 0 etc.

I claim:

1. A display device, comprising:

a liquid-crystal material between two supporting plates kept at a defined spacing having surfaces facing each other;

a pattern of line electrodes being arranged on one of the surfaces, and a pattern of column electrodes being arranged on another of the surfaces, the line electrodes crossing the column electrodes and forming display elements at the crossings;

a control circuit for supplying data signals to the column electrodes;

a line-scanning circuit for periodic scanning of the line electrodes and supplying line-select voltage signals during a frame timespan of the periodic scanning of the line electrodes, a plurality of lines being selected simultaneously during a selection timespan, the selection timespan being split into a plurality of spaced selection time intervals, said spaced selection time intervals being distributed over the corresponding frame timespan such that the sum of said spaced selection time intervals is equal to the selection timespan, the line-select voltage signals to be applied to each of the lines selected simultaneously being a plurality of signals, each signal occurring during a spaced selection time interval.

2. A display device according to claim 1, wherein amplitudes of the line-select voltage signals are equal for each of the lines to be selected simultaneously.

3. A display device according to claim 1 wherein the line-select voltage signals of the lines to be selected simultaneously are mutually orthogonal.

4. A display device according to claim 1 or 2 or 3 wherein for each group of n lines to be selected simultaneously, the selection timespan is split such that during scanning of N lines not more than n lines are selected simultaneously, the select voltages to be applied to each of the lines to be selected simultaneously during these time intervals being identical to the portions of original line-select voltage signals of the lines corresponding to the plurality of spaced selection time intervals.

5. A display device according to claim 1 or 2 or 3 wherein an even number of lines is selected simultaneously during the selection timespan, one of the line-select voltage signals to be applied being a half-period of said selection timespan, and the other line-select voltages which are applied simultaneously to the remaining lines during said selection timespan being low frequency voltage signals two, four, or eight lines selected during the scanning.

6. A display device according to claim 1 or 2 or 3 wherein the selection time during the scanning of an N-line matrix, not more than eight lines are selected simultaneously, line-select voltages to be applied to each of the eight lines to be selected simultaneously during said plurality of time intervals being identical with the corresponding portions of original line-select voltage signals.

7. A display device according to claim 1 or 2 or 3 wherein said equal time intervals being for selection simultaneously of two, four, or eight lines.

8. A display device according to claim 1 or 2 or 3 wherein an odd number of lines is selected simultaneously during a selection timespan per frame time.

9. A display device according to claim 1 or 2 or 3 wherein four lines selected simultaneously result in voltage wave forms where n+1 voltage levels can be distinguished at times when n lines are selected simultaneously.

10. A display device according to claim 1 or 2 or 3 wherein the amplitude $Y_n$ of the line-select voltages in the case of simultaneous selection of n lines is given by $Y_n=N^{1/2}*X_n/n$, $X_n$ being the maximum data voltage occurring in the data signals, and $X_n$ being given by $X_n=n^{1/2}*V_1*\{0.5/(1-N^{1/2})\}^{1/2}$, where $V_1$ is equal to a threshold voltage or an effective RMS voltage value of a display element in the 'OFF' state.

11. A display device according to claim 1 or 2 or 3 where the number of lines N of the matrix is not a multiple of the number of lines n to be selected simultaneously, the matrix is scanned while extending it by a number of virtual or 'dummy' lines $n_v$ such that the sum of N and $n_v$ is a multiple of n, it being possible when determining the amplitudes $Y_n$ and $X_n$ of the required line-select voltages and data voltages, for the value of N in the expressions where the amplitude $Y_n$ of the line-select voltages in the case of simultaneous selection of n lines is given by $Y_n=N^{1/2}*X_n/n$, $X_n$ being the maximum data voltage occurring in the data signals, and $X_n$ being given by $X_n=n^{1/2}*V_1*\{0.5/(1-N^{1/2})\}^{1/2}$, where $V_1$ is equal to a threshold voltage or an effective RMS voltage value of a display element in the 'OFF' state to be replaced by the value of $N+n_v$.

* * * * *